US009024515B2

(12) United States Patent
Melkes et al.

(10) Patent No.: US 9,024,515 B2
(45) Date of Patent: May 5, 2015

(54) LIGHTED BLOCKING BEAM

(75) Inventors: Mario Melkes, Koppl (AT); Jürgen Schieren, München (DE)

(73) Assignee: Skidata AG, Salzburg (AT)

( * ) Notice: Subject to any disclaimer, the term of this patent is extended or adjusted under 35 U.S.C. 154(b) by 108 days.

(21) Appl. No.: 13/476,612

(22) Filed: May 21, 2012

(65) Prior Publication Data

US 2013/0128569 A1 May 23, 2013

(30) Foreign Application Priority Data

Nov. 25, 2011 (EP) ..... 11190738

(51) Int. Cl.
*F21S 8/00* (2006.01)
*F21V 13/04* (2006.01)
*E01F 13/06* (2006.01)

(52) U.S. Cl.
CPC ..... *F21V 13/04* (2013.01); *E01F 13/06* (2013.01)

(58) Field of Classification Search
CPC ..... F21V 13/04; F21V 33/00; E01F 13/06; F21S 8/00; G06F 13/041
See application file for complete search history.

(56) References Cited

U.S. PATENT DOCUMENTS 6,212,825 B1 4/2001 Hopkins, Jr.
7,258,461 B1 * 8/2007 Izardel et al. ..... 362/152
8,845,125 B1 * 9/2014 Lumsden et al. ..... 362/152
2007/0199243 A1 8/2007 Youn
2011/0113662 A1 * 5/2011 Saunders et al. ..... 40/582

FOREIGN PATENT DOCUMENTS

| | | | |
|---|---|---|---|
| AT | 006 958 | U1 | 6/2004 |
| DE | 1405696 | A | 10/1961 |
| DE | 3719912 | A1 | 12/1988 |
| DE | 20 2010 006 973 | U1 | 9/2010 |
| EP | 2 105 534 | A2 | 5/2008 |
| FR | 1.392.127 | A | 4/1964 |
| JP | 2003-147735 | A | 5/2003 |

OTHER PUBLICATIONS

The International Search Report for DE 20 2011 050 275.9, dated competed Apr. 20, 2012, date mailed Apr. 25, 2012.

* cited by examiner

*Primary Examiner* — Donald Raleigh
(74) *Attorney, Agent, or Firm* — Miller, Canfield, Paddock and Stone; Mark L Maki

(57) ABSTRACT

The invention proposes a barrier comprising a blocking beam (1) that is mounted on a console such that it can be moved between an open position and a blocking position, wherein the blocking beam (1) is realized in the form of a tube section, on one end (2) of which a lamp (3) is arranged in a lens (4) that allows a linear light scattering in the direction of the other end of the tube section essentially parallel to the longitudinal axis (5) thereof, and on the other end (11) of which a device (9) for reflecting the light emitted by the lamp (3) is arranged, wherein the axial part of the tube section that extends between the lamp (3) and the device (9) for reflecting the light is realized in a translucent or transparent fashion.

13 Claims, 2 Drawing Sheets

LIGHTED BLOCKING BEAM

CROSS REFERENCE TO RELATED APPLICATIONS

This application claims the benefit of priority to German utility model 20 2011 050 275.9 filed May 27, 2011 and European patent application EP 11 190 738.2 filed Nov. 25, 2011, which are incorporated herein by reference in their entirety.

FIELD OF THE INVENTION

The invention pertains to a barrier that comprises a blocking beam according to the preamble of Claim 1.

BACKGROUND OF THE INVENTION

It is known from the prior art to provide blocking beams of barriers such as, for example, blocking beams of parking barriers with luminous LEDs. For example, U.S. Pat. No. 7,258,461 B1 describes a blocking beam of a barrier, on which LEDs that can be illuminated in red and green are mounted in order to indicate the open position and the blocking position of the barrier.

Furthermore, EP 2 105 534 A2 describes a barrier with a blocking beam that is mounted on a console such that it can be moved between an open position and a blocking position, wherein the blocking beam is realized in the form of a translucent tube, in which a strip fitted with light-emitting diodes is arranged. In the known barrier, it is furthermore proposed that the strip fitted with light-emitting diodes essentially extends over the entire length of the blocking beam.

The design disclosed in EP 2 105 534 A2 provides the advantage that the LEDs render the blocking beam clearly visible without running the risk of easily damaging the LEDs.

When using LEDs, it is disadvantageous that long blocking beams are associated with high manufacturing costs because a plurality of LEDs are required for illuminating the blocking beam over its entire length.

Furthermore, blocking beams known from the prior art which comprise strips fitted with light-emitting diodes cannot be realized with any length because the strips fitted with light-emitting diodes consist of prefabricated sections that respectively have a length between 10 and 30 cm. The present invention therefore is based on the objective of disclosing a barrier, the blocking beam of which can be illuminated over its entire length without requiring a plurality of LEDs. The illumination of the blocking beam of a barrier should, in particular, be achieved with only one lamp or with a limited number of lamps.

This objective is attained with the characteristics of Claim 1. Other embodiments and advantages of invention result from the dependent claims.

Accordingly, the proposed barrier comprises a blocking beam that is mounted on a console such that it can be moved between an open position and a blocking position, wherein the blocking beam is realized in the form of a tube section, on one end of which a lamp is arranged in a lens that allows a linear light scattering in the direction of the other end of the tube section essentially parallel to the longitudinal axis thereof, and on the other end of which a device for reflecting the light emitted by the lamp is arranged, and wherein the axial part of the tube section that extends between the lamp and the device for reflecting the light is realized in a translucent or transparent fashion.

The lamp is preferably realized in the form of an RGB- or white Power-LED. The lens may have reflective properties and be realized, for example, in the form of a parabolic mirror. Furthermore, a reflector may be used in addition to the lens in order to realize the linear light scattering in the direction of the other end of the tube section essentially parallel to the longitudinal axis thereof.

According to an additional development of the invention, the electronics for operating the lamp or the Power-LED are also arranged on the end of the tube section, on which the lamp is arranged. According to the invention, the cooling element for dissipating the heat generated by the lamp is also arranged on this end.

In order to simplify the assembly, as well as maintenance procedures, each end of the tube section features an end cap, the removal of which makes it possible to easily access the lamp and, if applicable, the electronics for operating the lamp or the device for reflecting the light emitted by the lamp, respectively. In this case, the cooling element for dissipating the heat generated by the lamp may simultaneously serve as a spacer referred to an end cap.

According to a particularly advantageous embodiment of the invention, the lamp, the lens and the electronics for operating the lamp are mounted on the end cap assigned to the end of the tube section, on which the lamp is arranged, by means of a cooling element for dissipating the heat generated by the lamp which simultaneously serves as a spacer.

Furthermore, the device for reflecting the light emitted by the lamp may alternatively or additionally be mounted on the end cap provided on the end of the tube section containing the reflecting device.

Within the scope of an additional development of the invention, the inventive barrier may feature a blocking beam that is realized in the form of an articulated beam and features two or more tube sections that are connected to one another in an articulated fashion. In this case, at least one of these tube sections is realized in accordance with the invention as already described above.

According to an additional development of the invention, the blocking beam features at least one additional lamp on the end, on which the lamp is arranged in a lens, wherein the additional lamp is respectively arranged in a lens that allows a linear light scattering in the direction of the other end of the tube section essentially parallel to the longitudinal axis thereof, wherein at least one device for reflecting the emitted light is arranged on the other end of the blocking beam, and wherein each lamp is respectively assigned a device for reflecting the light emitted by the lamp or all lamps are assigned one device for reflecting the light emitted by the lamps.

The lenses may have reflective properties and be realized, for example, in the form of a parabolic mirror. It is also possible to use reflectors in addition to the lenses in order to linearly scatter light in the direction of the other end of the tube section essentially parallel to the longitudinal axis thereof.

The inventive concept makes available a barrier, the blocking beam of which can be homogeneously illuminated by means of one lamp or by means of a limited number of lamps. The inventive solution furthermore makes it possible to achieve a homogenous illumination of blocking beams with a significant length such as, for example, a length on the order of 5 m.

In contrast to blocking beams known from the prior art which feature LED-strips with sections of predefined length, the invention furthermore makes it possible to shorten the blocking beam of the barrier to any length.

BRIEF DESCRIPTION OF THE DRAWINGS

The invention is described in an exemplary fashion below with reference to the attached figures. In these figures.

DETAILED DESCRIPTION

Figure 1:
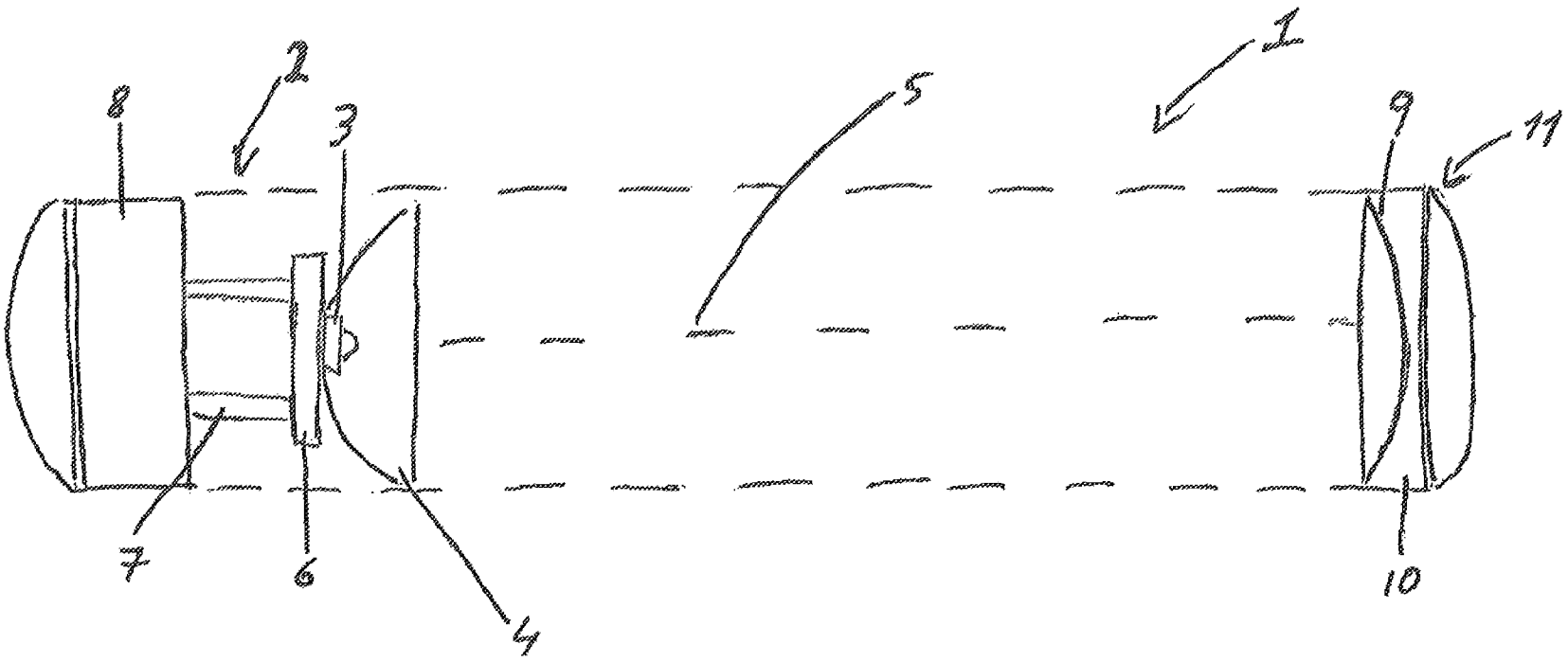
FIG. 1 shows a schematic sectional representation of an embodiment of a blocking beam of a barrier that is realized in accordance with the invention.

In attached FIG. 1, the reference symbol 1 identifies a blocking beam that is realized in the form of a tube section. A Power-LED 3 is arranged in a lens 4 on one end 2 of the blocking beam 1, wherein the lens 4 is realized in such a way that it allows a linear light scattering of the light of the Power-LED 3 essentially parallel to the longitudinal axis 5 of the blocking beam. The Power-LED 3 and the lens 4 are connected to an end cap 8 that closes the blocking beam 1 together with the electronics 6 for operating the Power-LED by means of a part 7 that serves as a spacer and as a cooling element for dissipating the heat generated by the Power-LED.

According to attached FIG. 1, a device 9 for reflecting the light emitted by the Power-LED 3 is provided on the other end 11 of the blocking beam 1. In the example shown, the device 9 in the form of a reflector is connected to the end cap 10 for closing the end 11 of the blocking beam 1.

This design and, in particular, the connection of the lamp 3 to the lens 4 and the connection of the reflector 9 to the respective end cap 8 or 10 make it possible to easily realize the assembly and the repair of the inventive barrier.

Figure 2:
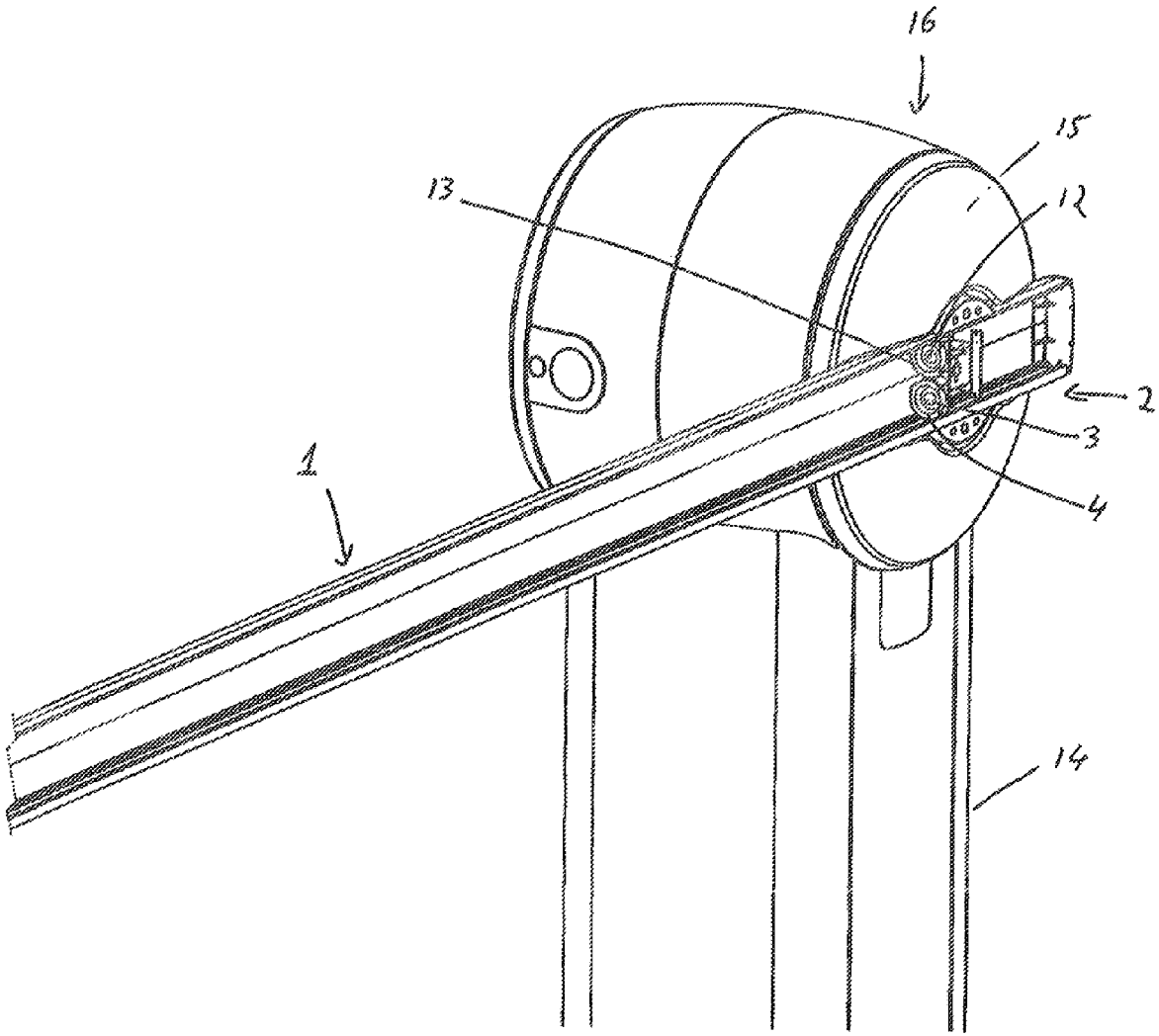
FIG. 2 shows a perspective representation of another embodiment of the invention.

With reference to FIG. 2, the barrier 1 may, according to the invention, feature at least one additional lamp 12 on the end 2, on which the lamp 3 is arranged in a lens 4, wherein the additional lamp is respectively arranged in a lens 13 that allows a linear light scattering in the direction of the other end of the tube section, essentially parallel to the longitudinal axis thereof. On its other end, the blocking beam 1 features at least one device for reflecting the emitted light, wherein each lamp 3, 12 is respectively assigned a device for reflecting the light emitted by the lamp or all lamps 3, 12 are assigned one device for reflecting the light emitted by the lamps 3, 12, and wherein the electronics for operating the lamps 3, 12 are arranged on the end of the tube section, on which the lamps 3, 12 are arranged. In the example illustrated in FIG. 2, a total of two lamps 3, 12, preferably in the form of RGB- or white Power-LEDs, are provided and arranged mirror-symmetrical referred to the longitudinal axis of the blocking beam 1.

Furthermore, at least the axial part of the tube section extending between the two lamps 3, 12 and the at least one device for reflecting the light is realized in a translucent or transparent fashion.

Analogous to the embodiment according to FIG. 1, each end of the tube section may feature an end cap, the removal of which makes it possible to access the lamps 3, 12 and, if applicable, the electronics for operating the lamps 3, 12 or the at least one device for reflecting the light emitted by the lamps 3, 12, respectively.

In addition, the lamps 3, 12, the lenses 4, 13 and the electronics for operating the lamps 3, 12 may be mounted on the end cap assigned to the end of the tube section, on which the lamps 3, 12 are arranged, by means of a cooling element for dissipating the heat generated by the lamps which simultaneously serves as a spacer. Furthermore, the at least one device for reflecting the light emitted by the lamps 3, 12 may be mounted on the end cap provided on the end of the tube section that contains at least one reflecting device.

The blocking beam 1 may comprise another tube section and be realized in the form of an articulated beam, wherein the additional tube section is connected to the first tube section in an articulated fashion and may be realized in accordance with the tube section that forms the blocking beam 1 in FIG. 1 or FIG. 2.

The barrier illustrated in FIG. 2 is realized in such a way that the blocking beam 1 is connected in a rotationally rigid fashion to a barrier head disk 15 on the end that faces the console referred to as the barrier column 14, wherein this barrier head disk is connected in a rotationally rigid fashion to the electrically driven barrier beam shaft in the region of the barrier head 16 of the barrier column 14, and wherein the end of the blocking beam 1 that faces the barrier column is accommodated in a form-fitting fashion in a receptacle of the barrier head disk 15. Furthermore, the blocking beam 1 is connected to the barrier head disk 15 in the direction parallel to the pivoting axis of the barrier beam 1 by means of non-positive connecting elements with break-off function such that a predetermined breaking point is integrated into the connecting elements between the barrier head disk 15 and the blocking beam 1.

The invention claimed is:

1. A barrier comprising a blocking beam that is mounted on a console such that said blocking beam can be moved between an open position and a blocking position, characterized in that the blocking beam is shaped in the form of a tube section having a hollow interior extending between opposite ends of said tube section wherein one said end is mounted on said console, in one of said ends of said tube section within said hollow interior a lamp being arranged in a lens that allows a linear light scattering within the hollow interior of the tube section in the direction towards the other said end of the tube section essentially parallel to the longitudinal axis thereof, and on the other said end of said tube section a device being provided within the tube section for reflecting the light emitted by the lamp, wherein an axial part of the tube section extends between the lamp and the device for reflecting the light and is realized in a translucent or transparent fashion wherein the light is transmitted from said hollow interior to an exterior of said blocking beam;

each said end of the tube section including an end cap which enclose opposite ends of said hollow interior, wherein removal of a first one of said end caps at one end of the tube section provides access to the lamp and electronics for operating the lamp and removal of a second one of said end caps provides access to the device for reflecting the light emitted by the lamp;

the lamp, the lens and the electronics for operating the lamp being mounted on the first end cap assigned to the one end of the tube section, by means of a cooling element for dissipating the heat generated by the lamp which simultaneously serves as a spacer and/or the device for reflecting the light emitted by the lamp being mounted on the second end cap provided on the other end of the tube section.

2. The barrier according to claim 1, characterized in that the lamp is realized in the form of an RGB- or white Power-LED.

3. The barrier according to claim 1, characterized in that said electronics for operating the lamp are arranged on the one end of the tube section, on which the lamp is arranged.

4. The barrier according to claim 1, characterized in that the blocking beam comprises said tube section, which is a first tube section, and an additional tube section and is realized in the form of an articulated beam, wherein the additional tube section and the first tube section are connected to one another in an articulated fashion.

5. The barrier according to claim 4, characterized in that the additional tube section is realized in accordance with the construction of the first tube section.

6. The barrier according to claim 1, characterized in that blocking beam features at least one additional lamp on the one end, on which the lamp is arranged in the lens, wherein the additional lamp is respectively arranged in a lens that allows a linear light scattering in the direction of the other end of the tube section essentially parallel to the longitudinal axis thereof, and in that the blocking beam features at least one said device for reflecting the emitted light on its other end, wherein each lamp is respectively assigned one said device for reflecting the light emitted by the lamp- or all lamps are assigned one said device for reflecting the light emitted by the lamps.

7. The barrier according to claim 6, characterized in that the lamps are realized in the form of RGB- or white Power-LEDs.

8. The barrier according to claim 6, characterized in that electronics for operating the lamps are arranged on the one end of the tube section, on which the lamps are arranged.

9. The barrier according to claim 6, characterized in that each end of the tube section features a respective said end cap, the removal of which makes it possible to access the lamps and any electronics for operating the lamps or the at least one device for reflecting the light emitted by the lamps, respectively.

10. The barrier according to claim 9, characterized in that the lamps, the lenses and the electronics for operating the lamps are mounted on the end cap assigned to the one end of the tube section, on which the lamps are arranged, by means of a cooling element for dissipating the heat generated by the lamps which simultaneously serves as a spacer and/or that the at least one device for reflecting the light emitted by the lamps is mounted on the end cap provided on the other end of the tube section that contains the at least one reflecting device.

11. The barrier according to claim 6, characterized in that the blocking beam comprises said tube section, which is a first tube section, and another tube section and is realized in the form of an articulated beam, wherein the additional tube section and the first tube section are connected to one another in an articulated fashion.

12. The barrier according to claim 11, characterized in that the additional tube section is realized in accordance with the construction of the first tube section.

13. The barrier according to claim 6, characterized in that two lamps are provided and arranged mirror-symmetrical referred to the longitudinal axis of the blocking beam.

* * * * *